US006279775B1

(12) United States Patent
Parkes et al.

(10) Patent No.: US 6,279,775 B1
(45) Date of Patent: Aug. 28, 2001

(54) TISSUE DISPENSER FOR A VEHICLE CUP HOLDER

(75) Inventors: Timothy H. Parkes, Ooltewah, TN (US); Arnold M. King, Spring Valley, NY (US)

(73) Assignee: Remington Industries, Inc., Chattanooga, TN (US)

( * ) Notice: Subject to any disclaimer, the term of this patent is extended or adjusted under 35 U.S.C. 154(b) by 0 days.

(21) Appl. No.: 09/245,672

(22) Filed: Feb. 8, 1999

(51) Int. Cl.[7] ..... B65H 1/00

(52) U.S. Cl. ..... 221/63; 221/185

(58) Field of Search ..... 221/63, 185

(56) References Cited

U.S. PATENT DOCUMENTS

| | | | | |
|---|---|---|---|---|
| D. 338,597 | | 8/1993 | Dickey et al. . | |
| D. 360,790 | | 8/1995 | Landis et al. . | |
| D. 371,708 | | 7/1996 | Haley et al. . | |
| D. 376,959 | | 12/1996 | Norris . | |
| D. 397,915 | | 9/1998 | McNaughton . | |
| 4,171,047 | * | 10/1979 | Doyle et al. | 221/63 X |
| 4,181,218 | * | 1/1980 | Cox | 221/63 X |
| 4,462,507 | * | 7/1984 | Marqulies | 221/63 |
| 4,694,973 | * | 9/1987 | Rose et al. | 221/63 X |
| 5,007,558 | | 4/1991 | Allen et al. . | |
| 5,174,534 | | 12/1992 | Mitchell . | |
| 5,180,088 | | 1/1993 | De Angeli . | |
| 5,467,893 | * | 11/1995 | Landis, II et al. | 221/63 X |
| 5,516,000 | | 5/1996 | Freiburger et al. . | |
| 5,560,514 | * | 10/1996 | Frazier | 221/63 |
| 5,718,353 | * | 2/1998 | Kanfer et al. | 221/63 |
| 5,769,266 | | 6/1998 | Willbrandt . | |
| 5,803,249 | | 9/1998 | Harsanyi, Jr. et al. . | |

OTHER PUBLICATIONS

U.S. Application No. 29/089,698, Parkes, et al., filed Jun. 18, 1998.

* cited by examiner

*Primary Examiner*—David H. Bollinger
(74) *Attorney, Agent, or Firm*—Kent R. Moore

(57) ABSTRACT

A tissue dispenser which includes a container portion for holding tissues or other articles. The container portion includes a lower portion which may fit within an adjustable or non-adjustable vehicle cup holder, a transition portion positioned above the lower portion, and an upper portion positioned above the transition portion. The lower portion preferably has a diameter that can fit most non-adjustable vehicle cup holders provided by automobile manufacturers. The transition portion extends outwardly from the lower portion and typically has a flare-like shape. The upper portion extends upward from the transition portion and is preferably larger in height and diameter than the lower portion in order to increase the containment volume for the present tissue dispenser. The lower portion, transition portion and upper portion of the container portion define an interior space for receiving and containing tissues or other articles to be dispensed by the present tissue dispenser. The top of the upper portion defines an opening for inserting tissues or other articles to be dispensed by the present tissue dispenser. The opening of the container portion also receives a dispensing cap for dispensing tissues. The dispensing cap may be removably attached to the container portion so that the dispensing cap may be removed occasionally in order to refill the container portion with tissues. The dispensing cap may be secured to the container portion in a manner that provides a seal for the present tissue dispenser so that evaporation is minimized to prevent the enclosed tissues from drying. The dispensing cap may include an aperture through which the tissues or other articles may be dispensed. The dispensing cap also may include a closable lid to cover the aperture and further seal the tissue dispenser to prevent evaporation through the aperture.

11 Claims, 10 Drawing Sheets

TISSUE DISPENSER FOR A VEHICLE CUP HOLDER

FIELD

The present invention relates to tissue dispensers and more particularly to tissue dispensers which are designed to fit within vehicle cup holders.

BACKGROUND

Disposable moist towelettes or tissues are very popular in today's society. Their use ranges from patient care in hospitals to personal hygiene. One use in particular, the baby wipe, has become increasingly popular. As the name connotes, baby wipes are often used to clean babies after changing diapers, although baby wipes have may other applications. As anyone who has changed a diaper knows, the need for baby wipes can arise during a trip to the grocery store or during a vacation across the country. Therefore, it is essential to have a dispenser or container that is easy to transport and easy to locate. However, baby wipes are commonly packaged in large, bulky containers which make the containers difficult to transport, particularly on trips or vacations. The large round containers can be particularly difficult to store in a vehicle because there is not a convenient place to store the container. Often, attempts to store the containers under the seat are unsuccessful since any stop or curve may cause the container to roll from underneath the seat to another location. Once the container moves to another location, it may become difficult to locate or may become damaged and fail to properly dispense tissues.

SUMMARY

The present invention overcomes the disadvantages of existing tissue dispensers by providing a tissue dispenser that is designed to be placed in most vehicle cup holders. By placing the tissue dispenser of the present invention in a cup holder, the tissue dispenser is easily located and readily accessible. Moreover, such a convenient location prevents damage to the present tissue dispenser.

One embodiment of the present tissue dispenser includes a container portion for holding tissues or other articles. The container portion includes a lower portion which may fit within an adjustable or non-adjustable vehicle cup holder, a transition portion positioned above the lower portion, and an upper portion positioned above the transition portion. Because non-adjustable cup holders are typically more prevalent in vehicles, it is preferred that the present tissue dispenser have a size which can be placed in non-adjustable cup holders. Therefore, the lower portion preferably has a diameter that is equal to or less than about two and six-tenths inches (2.6") which is the size for most non-adjustable vehicle cup holders provided by automobile manufacturers.

The transition portion extends outwardly from the lower portion and typically has a flare-like shape. Preferably, the transition portion expands the diameter of the present tissue dispenser to around three inches (3"). The transition portion also may create a ledge or shelf which rests on the edge of the vehicle cup holder when the tissue dispenser of the present invention is placed in the cup holder.

The upper portion extends upward from the transition portion and is preferably larger in height and diameter than the lower portion in order to increase the containment volume for the present tissue dispenser. In a particularly preferred embodiment, the sidewall of the upper portion is tilted outwardly so that the upper portion gradually increases in diameter as it increases in height. The lower portion, transition portion and upper portion of the container portion define an interior space for receiving and containing tissues or other articles to be dispensed by the present tissue dispenser. The top of the upper portion defines an opening for inserting tissues or other articles to be dispensed by the present tissue dispenser.

The opening of the container portion also receives a dispensing cap for dispensing tissues. The dispensing cap may be removably attached to the container portion so that the dispensing cap may be removed occasionally in order to refill the container portion with tissues. Preferably, the dispensing cap may be secured to the container portion by a threaded connection, a snap connection, an adhesive connection, or any other connection that removably secures the dispensing cap to the container portion. However, for a disposable-type tissue dispenser, the dispensing cap may be integral with or permanently attach to the container portion.

The dispensing cap may be secured to the container portion in a manner that provides a seal for the present tissue dispenser so that evaporation is minimized to prevent the enclosed tissues from drying. The present tissue dispenser preferably contains tissues having an antimicrobial agent. The seal further prevents contaminants from entering the tissue dispenser thereby preserving the antimicrobial effect of the tissues. Such a seal is created by a first ridge located around the circumference of the opening at the top of the container portion and a second ridge which is located on the interior portion of the dispensing cap. The first and second ridges are substantially the same in diameter in order to create a compression fit between the two ridges. Therefore, when the dispensing cap is placed over the opening, the second ridge compresses the first ridge until the second ridge slips over the first ridge. Once the dispensing cap is secured in place, the second ridge rests below the first ridge and presses against the circumference of the opening on the container portion. Likewise, the first ridge presses against the interior surface of the dispensing cap. The cooperation among the first ridge and the circumference of the opening and the second ridge and the interior surface of the dispensing cap provides a seal for the present tissue dispenser. The compression fit also helps to prevent inadvertent removal of the dispensing cap.

The dispensing cap also may include an aperture through which the tissues or other articles may be dispensed. The aperture may be a hole or similar opening for dispensing solid articles such as tissues. The aperture may also define a nozzle or spout or similar structure for dispensing liquids or gels. Preferably, tissues which are connected along perforations are contained in the container portion. The aperture preferably includes tabs or other protrusions which slip between the perforations of the tissues in order to separate the tissues along the perforations as they are being dispensed. The dispensing cap may also include a closable lid to cover the aperture and further seal the tissue dispenser to prevent evaporation through the aperture.

The container portion may have other configurations. For example, in an alternate embodiment, the container portion may gradually increase in diameter from the base of the container portion to the top of the container portion so that the container portion is substantially conical in shape. In another alternate embodiment, the container portion is substantially cylindrical in shape so that the diameter is substantially consistent along the entire height of the container portion. Currently, it is believed that there is no existing tissue dispenser which has a diameter less than around three and one-eight inches (3.125") which makes existing tissue dispensers unsuitable for non-adjustable vehicle cup holders. An important feature of the present invention is that the cylindrically-shaped container portion has a size that can be accommodated by a large variety of non-adjustable vehicle cup holders. Therefore, it is critical that the present cylindrically-shaped tissue dispenser have a diameter of around three inches (3") or less in order to fit within a non-adjustable vehicle cup holder. Preferably, the present tissue dispenser has a diameter of about two and six-tenths inches (2.6").

Preferred materials of construction for the tissue dispenser 1 are plastics such as polypropylene or high density polyethylene (HDPE). However, other materials may be used such as paper or composite materials. Further, the present tissue dispenser may have cross-sectional configurations other than circular. For example, square, triangular, elliptical, or virtually any symmetrical or asymmetrical shape may be used so long as the container portion defines an interior space for storing articles such as tissues.

The described invention and its related embodiments will be better understood in view of the accompanying drawings and following detailed description.

DETAILED DESCRIPTION

Figure 1:
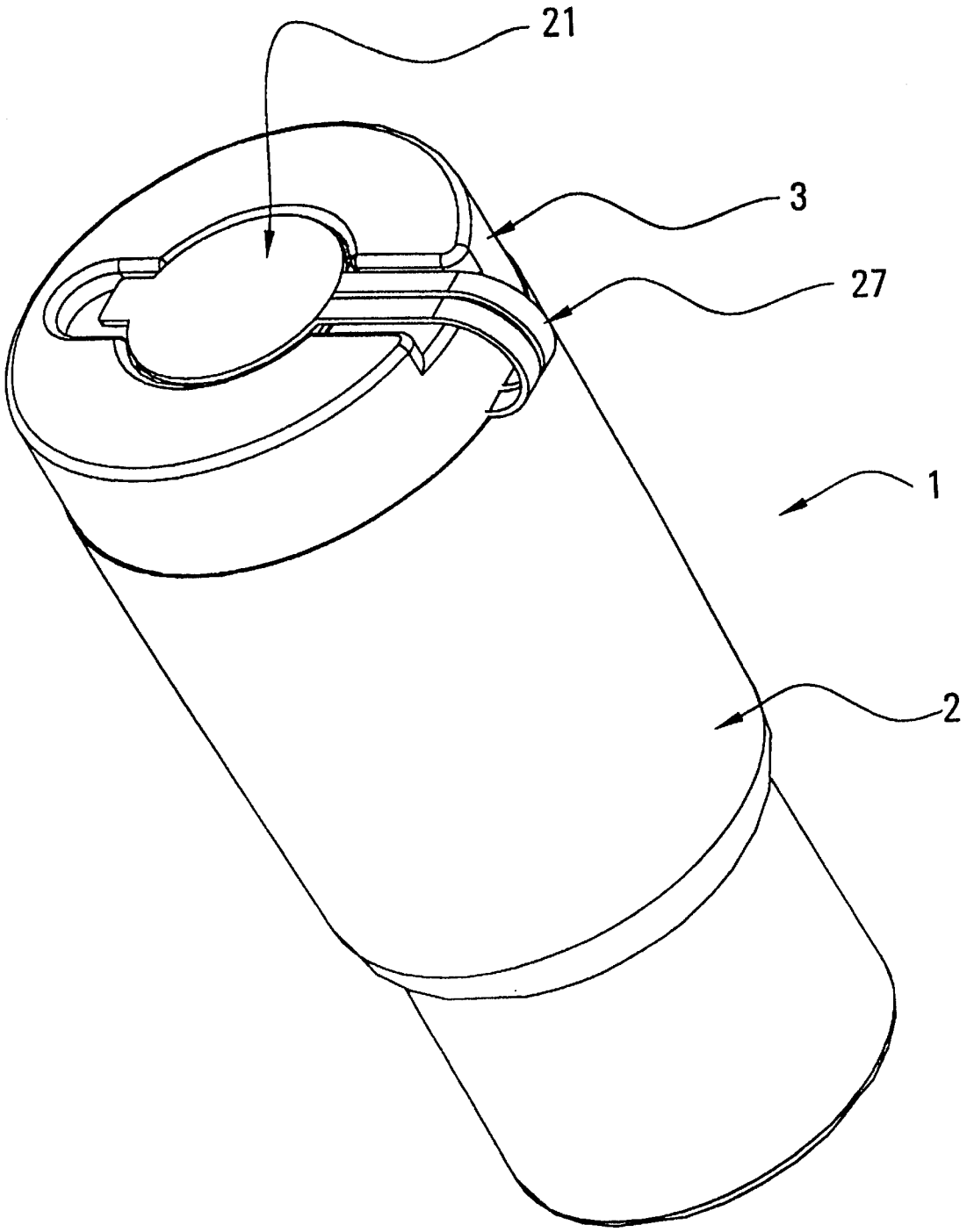
FIG. 1 is a perspective view illustrating a preferred embodiment of the present tissue dispenser.
Figure 2:
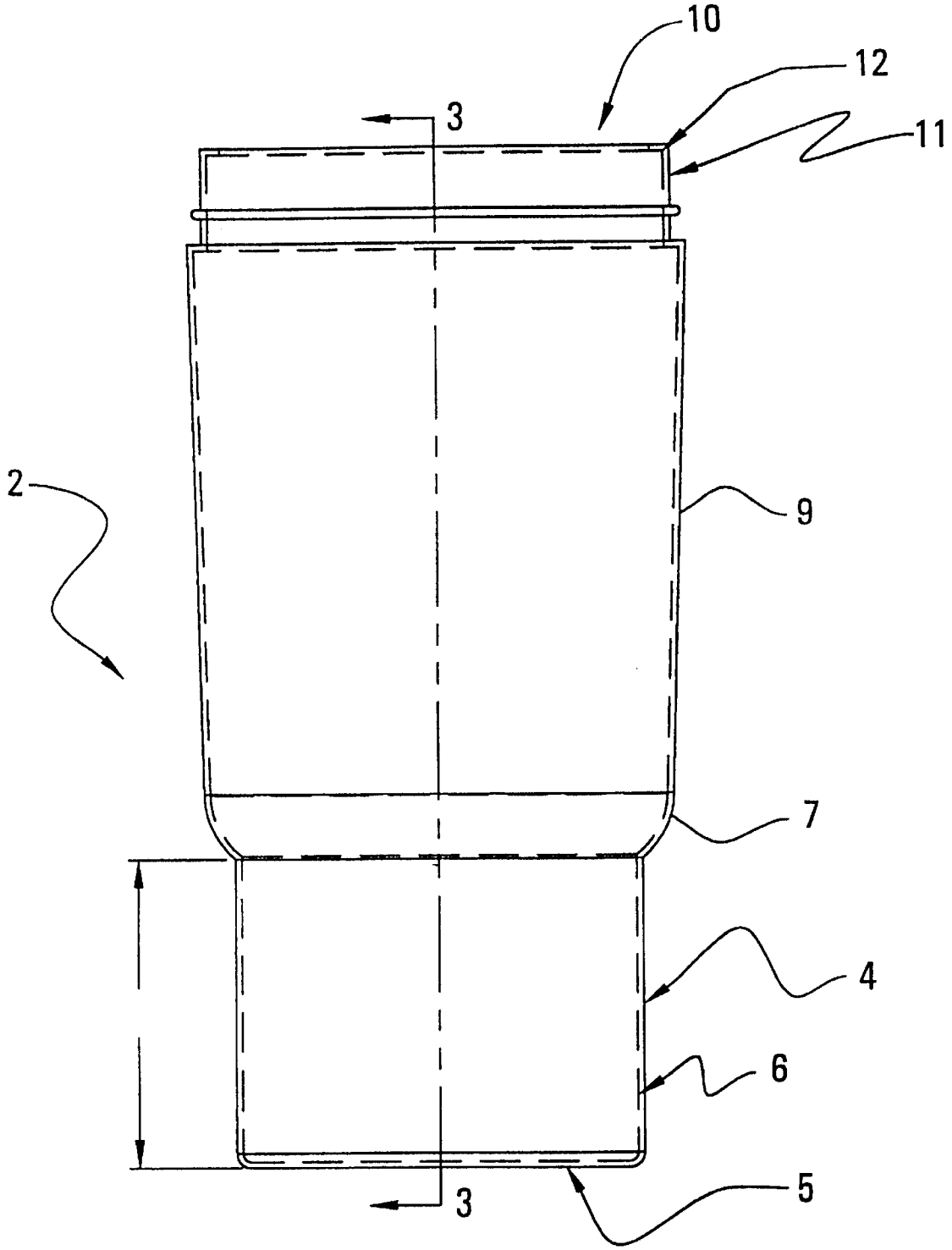
FIG. 2 is a side view of the tissue dispenser illustrated in FIG. 1.
Figure 3:
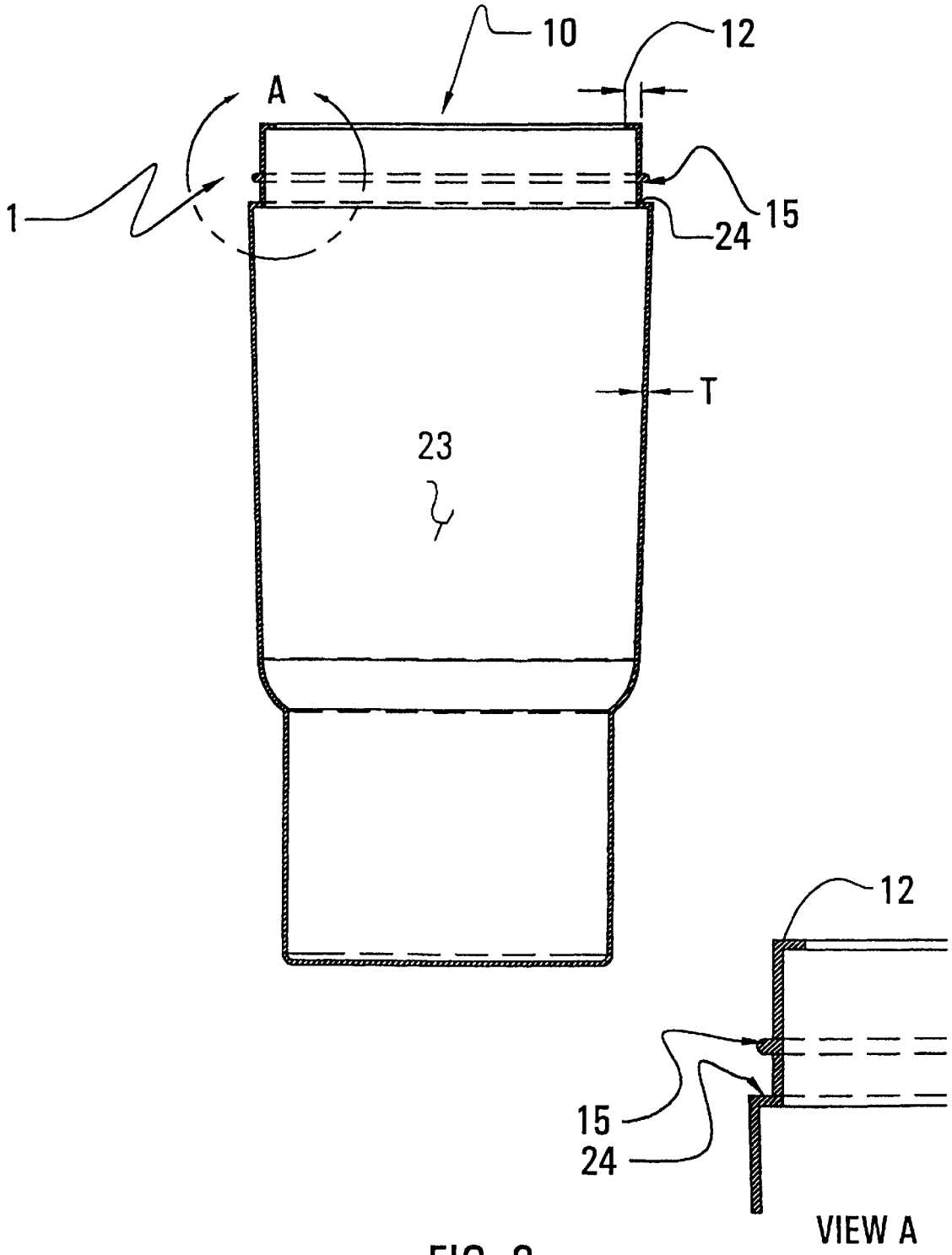
Fig. 3 is a view taken along cross-section line 3—3 of the tissue dispenser illustrated in FIG. 2.

Referring to the drawings, FIGS. 1–5 illustrate a preferred embodiment of the present invention which is designated generally as 1. The tissue dispenser 1 includes a container portion 2 for containing tissues (not shown) or other articles and a dispensing cap 3 which may be removably attached to the container portion 2 for dispensing the contained tissues and for sealing the container portion 2. As shown in FIG. 2, the container portion 2 includes a lower portion 4, a transition portion 7, and an upper portion 9.

The lower portion 4 includes a base 5 which is preferably large enough in size to allow the tissue dispenser 1 to stand upright. In a particularly preferred embodiment, the base 5 is circular in shape and has an outer diameter of around two and six-tenths inches (2.6") which is the diameter that will fit most non-adjustable vehicle cup holders. However, the base 5 may have a larger diameter for adjustable cup holders which are capable of expanding to have a larger cup holder diameter. The lower portion 4 also includes a first sidewall 6 which extends upward from the base 5 in a substantially perpendicular direction from the perimeter of the base 5 so that the lower portion 4 is substantially cylindrical in shape. Preferably, the lower portion 4 has a diameter of around two and six-tenths inches (2.6"). However, the diameter of the lower portion 4 may increase or decrease as the lower portion 4 increases in height. Height H of the lower portion 4 is preferably sufficient to allow the dispenser 1 to rest within a standard vehicle cup holder without slipping from the vehicle cup holder. In a particularly preferred embodiment, the height H is around two (2) inches.

A transition portion 7 is positioned above and extends in a generally outwardly direction from the lower portion so that the diameter of the transition portion 7 widens as it extends upward from the lower portion 4. The transition portion 7 creates a ridge or ledge which rests against the vehicle cup holder and is particularly helpful in stabilizing the tissue dispenser 1 of the present invention when inserted in a vehicle cup holder. The transition portion 7 may have many configurations but is preferably arcuate in shape to provide a smooth transition from the lower portion 4 to the upper portion 9 and to provide an aesthetically pleasing appearance to the tissue dispenser 1. Preferably, the transition portion 7 has a radius of around fifty-four one hundredths of one inch (0.54"). The increase in diameter may be from around one tenth of one inch (0.1") to around four inches (4.0") but is preferably around four-tenths of one inch (0.4"). The increase in diameter accommodates the wider diameter of the upper portion 9 and also increases the overall volume of the dispenser 1.

The upper portion 9 is positioned above and extends upward from the transition portion 7. Preferably, the upper portion 9 gradually increases in diameter as it extends upward, however, the upper portion 9 may remain constant in diameter or decrease in diameter. As illustrated in the cross-sectional view of a preferred embodiment shown in FIG. 3, the container portion 2 defines an interior space 23 for containing articles such as tissues. An opening 10 for inserting the articles to be contained in the tissue dispenser 1 is defined by the upper portion 9 of the container portion 2. In a preferred embodiment, a topmost portion 11 is disposed around the opening 10. The topmost portion 11 preferably has a substantially constant diameter and is substantially cylindrical in shape. In a particularly preferred embodiment, the topmost portion 11 has a smaller diameter than the upper portion 9 to create an inset area 24 around the upper portion 9. Preferably, a lip 12 may extend around the perimeter of the topmost portion 11 to provide added rigidity and strength to the opening 10. The lip 12 also provides a convenient area to secure a plastic or foil seal (not shown) during the manufacturing process.

The container portion 2 of present tissue dispenser 1 is preferably made from a plastic such as HDPE or polypropylene. The sidewall thickness T may be constant, increase or decrease throughout the height of the container portion 2. Although the sidewall thickness T is not confined to a particular range of dimensions, sidewall thickness T preferably is a preselected dimension that allows the container portion 2 to be slightly flexible or deformable. In a particularly preferred embodiment, the sidewall thickness T has a substantially constant thickness of around four one-hundredths of one inch (0.040").

The present tissue dispenser 1 also includes a dispensing cap 3 for dispensing tissues or other articles. Preferred materials for the dispensing cap 3 include plastics such as HDPE or polypropylene. Most preferably, the dispensing cap 3 is made from the same material as the container portion 2. The dispensing cap 3 also assists in sealing the tissue dispenser 1 once the foil seal has been removed by the consumer. The seal provided by the dispensing cap 3 accomplishes several objectives. As mentioned above, the present tissue dispenser 1 may contain tissues which are moistened to assist with cleaning. Further, the tissues may contain antimicrobial agents to provide protection against infection. The seal assists in preventing evaporation of moisture and preventing outside contamination which may cause bacteria growth inside the tissue dispenser 1 and which may lessen the antibacterial effect of the tissues.

Figure 4A:
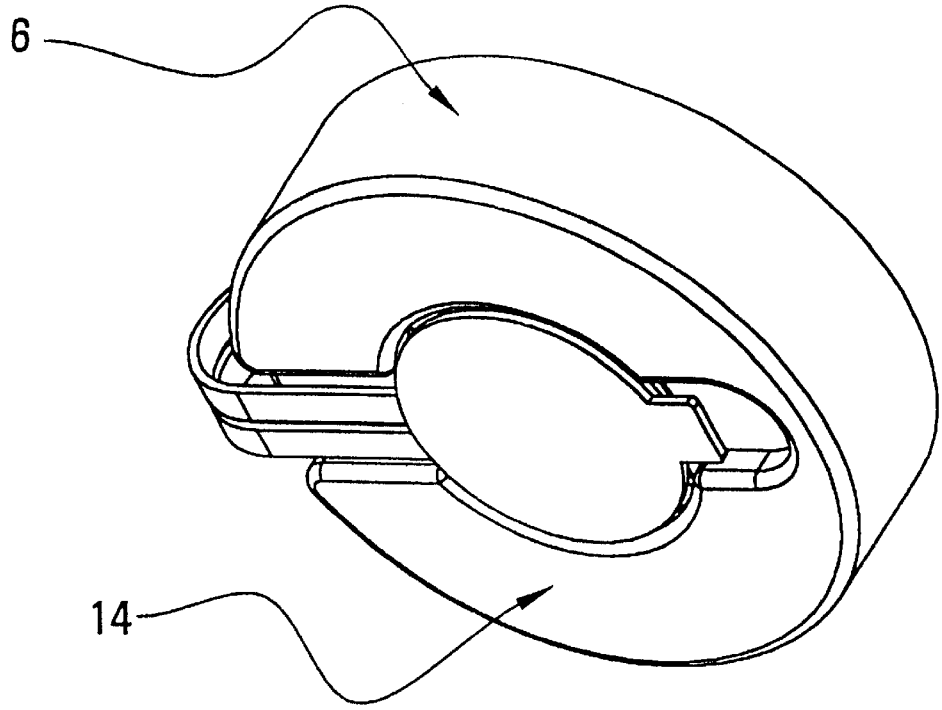
FIG. 4*a* is a top perspective view of a preferred embodiment of the dispensing cap of the present tissue dispenser.
Figure 4B:
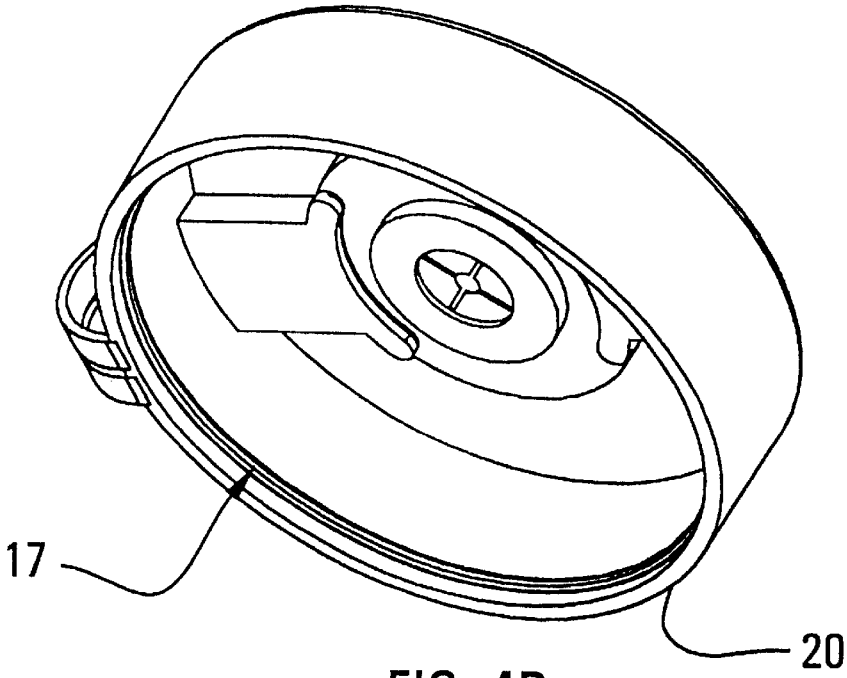
FIG. 4*b* is a bottom perspective view of the dispensing cap illustrated in FIG. 4*a*.

The dispensing cap 3 may be secured to the container portion 2 by any method which may be ascertainable to one skilled in the art or arts to which the present invention pertains or with which it is most nearly connected such as by a threaded connection, a snap connection, an adhesive connection or any other connection. However, in a preferred embodiment, the dispensing cap 3 is removably secured to the topmost portion 11 of the container portion 2. As illustrated in FIGS. 4*a* and 4*b*, the dispensing cap 3 may comprise a planar disc portion 14 which is substantially circular in shape. A second sidewall 16 which is substantially cylindrical in shape depends downwardly from the edge of the disc portion 14 and extends around the circumference of the disc portion 14. The inside diameter of the second sidewall 16 is preferably only slightly larger than the outer diameter of the topmost portion 11 to provide a secure fit between the dispensing cap 3 and the topmost portion 11. In the illustrated embodiment, the lower edge 20 of the second sidewall 16 of the dispensing cap 3 rests on the inset area 24 so that lateral/axial movement of the dispensing cap 3 relative to the container portion 2 is minimized. Moreover, when the dispensing cap 3 is secured to the container portion 2, the inset 24 allows the outer surface of the second sidewall 16 of the dispensing cap 3 to remain substantially flush with the outer surface of the upper portion 9.

The dispensing cap 3 and the container portion 2 may be provided with cooperating first and second ridges 15, 17 for securing the dispensing portion 3 to the container portion 2. The first ridge 15 and second ridge 17 are each preferably a raised bead of plastic which may be formed during the manufacturing process. The first ridge 15 is located around the perimeter of the exterior surface of the topmost portion 11. The second ridge 17 is disposed circumferentially around the interior surface of the second sidewall 16 of dispensing cap 3. Preferably, the second ridge 17 is located at a predetermined distance from the lower edge 20 so that when the dispensing cap 3 is secured to the container, the lower edge 20 rests on the inset area 24 and the second ridge is positioned below the first ridge 15 and preferably in touching relationship with the first ridge 15. Although illustrated as a continuous bead, the first ridge 15 or second ridge 17 may be intermittently disposed around the respective surfaces. The first ridge 15 and second ridge 17 are substantially the same in diameter in order to create a compression fit between the ridges 15, 17 when the dispensing cap 3 is pushed onto the container portion 2.

As previously mentioned, the container portion 2 is preferably slightly flexible or deformable. As the dispensing cap 3 is pushed over the opening 10 of the container portion 2, the first and second ridges 15, 17 contact each other. The force of the second ridge 17 against the first ridge 15 causes the first ridge 15 to deform slightly or compress and allows the second ridge 17 to slip over the first ridge 15. Once the dispensing cap 3 snaps into place and is secured over the opening 10, the second ridge 17 rests below the first ridge 15 and rests against the circumference of the opening 10 on the container portion 2. Likewise, the first ridge 15 rests against the interior portion of the dispensing cap 3. The cooperation between the first and second ridges 15, 17 provides a seal for the present tissue dispenser 1. The compression fit between the first and second ridges 15, 17 also helps to prevent inadvertent removal of the dispensing cap 3. If pressure or force is applied to the dispensing cap 3, such as the force applied when a tissue is being removed from the present tissue dispenser 1, the second ridge 17 engages the first ridge 15 thereby preventing inadvertent separation of the dispensing cap 3 from the container portion 2.

The dispensing cap 3 also may include an aperture 19 located in the disc portion 14 through which the tissues can be dispensed. In a preferred embodiment of the present dispenser 1, the tissues contained in the container portion 2 are connected by perforations. The tissues are fed through the aperture 19 in order to remove the tissues from the dispenser 1. To ensure that the tissues can be separated along the perforations as they are being removed from the dispenser 1, the aperture 19 typically includes one or more tabs 22 which catch the tissue along the perforations. Once the consumer draws the tissue through the aperture 19, each tissue easily separates along the perforations. Although the preferred embodiment of the present tissue dispenser 1 dispenses tissues, the present tissue dispenser 1 may also be suitable for other applications without tissues or similar substrate. For example, the aperture 19 may also define a nozzle or spout or similar structure (none shown) for dispensing liquids or gels.

Figure 5:
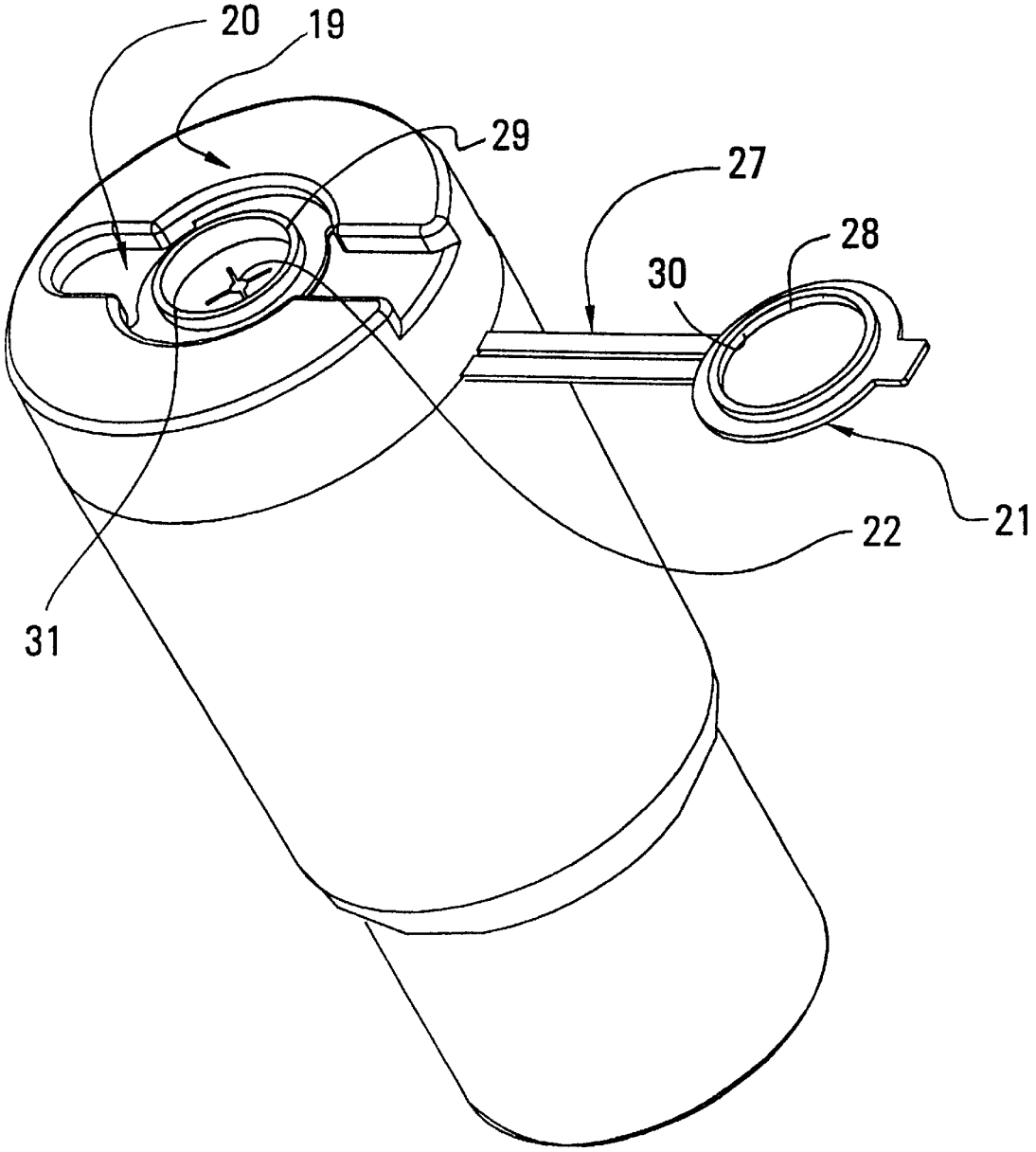
FIG. 5 is a perspective view of a preferred embodiment of the present tissue dispenser illustrating a closable lid in an open position.
Figure 6:
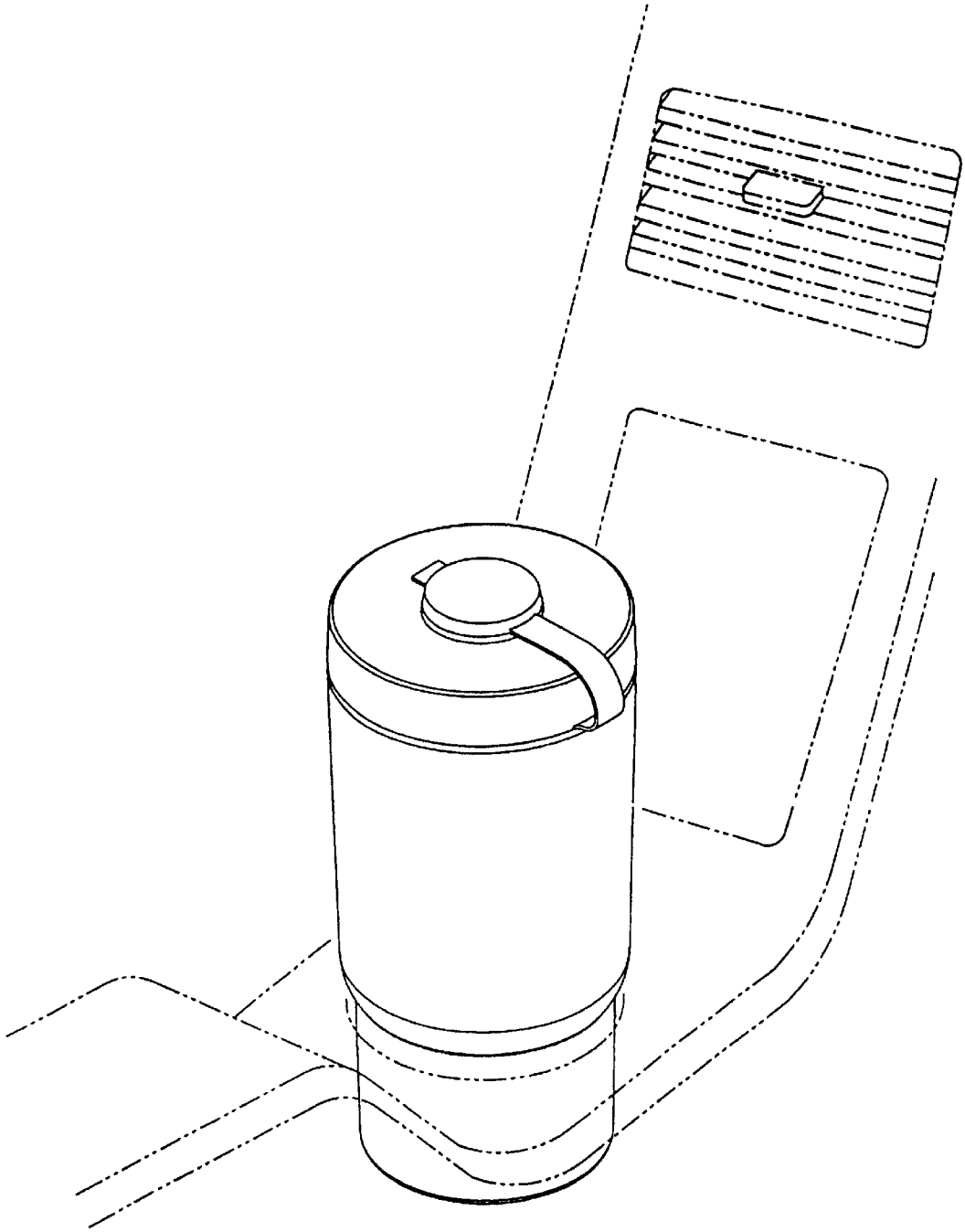
FIG. 6 is a perspective view of a first alternate embodiment of the present tissue dispenser inserted in a vehicle cup holder.

A closable lid 21 may also be provided to cover the aperture 19 when the tissue dispenser 1 is not in use. In a particularly preferred embodiment, the lid 21 is recessed in a recessed portion 26 defined by the disc portion 14 so that the top surface of the lid 21 is flush with the top surface of the disc portion 14. However, the lid 21 may have many different configurations. For example, FIG. 6 illustrates a first alternate embodiment of the present tissue dispenser 1 where the lid 21 is not recessed. Although the lid 21 need not be secured to the dispensing cap 3, the lid 21 may be secured to the dispensing cap 3 by a strap 27 as illustrated in FIG. 5 or by hinges (not shown) or any other manner to help prevent the lid 21 from being misplaced.

In order to prevent evaporation when the lid 21 is in the closed position, the lid 21 may be provided with a first ring 28 which cooperates with a second ring 29 located on the dispensing cap 3 around the aperture 19. The first ring 28 may define a groove 30 for receiving a corresponding bead 31 defined by the second ring 29. When the lid 21 is closed, the bead 31 of the second ring 29 snaps into the groove 30 defined by the first ring 28. The cooperation between the first and second rings 28, 29 lessens evaporation through the aperture 19.

Figure 7:
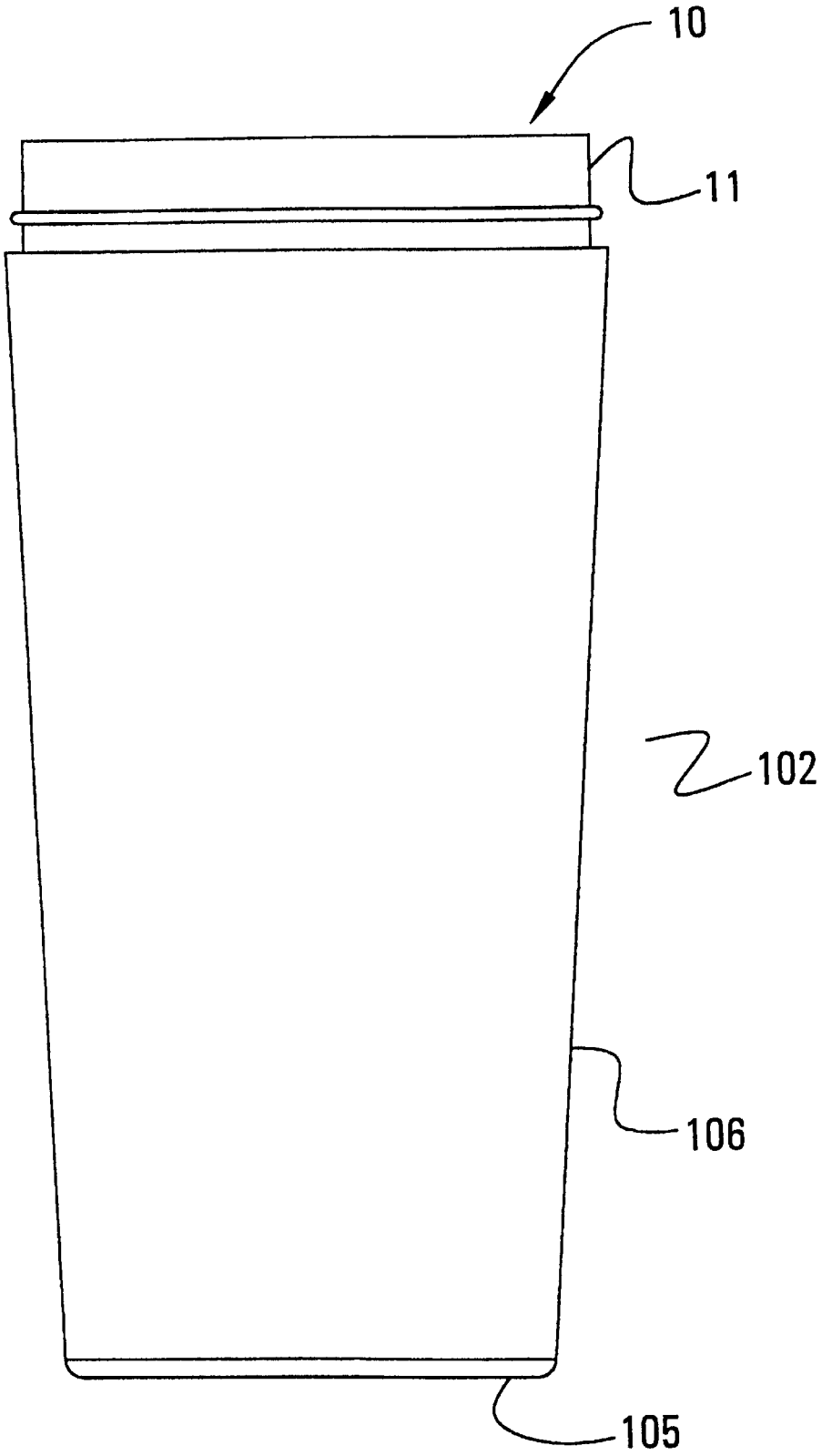
FIG. 7 is a side view of a second alternate embodiment of a container portion of the present tissue dispenser.
Figure 8:
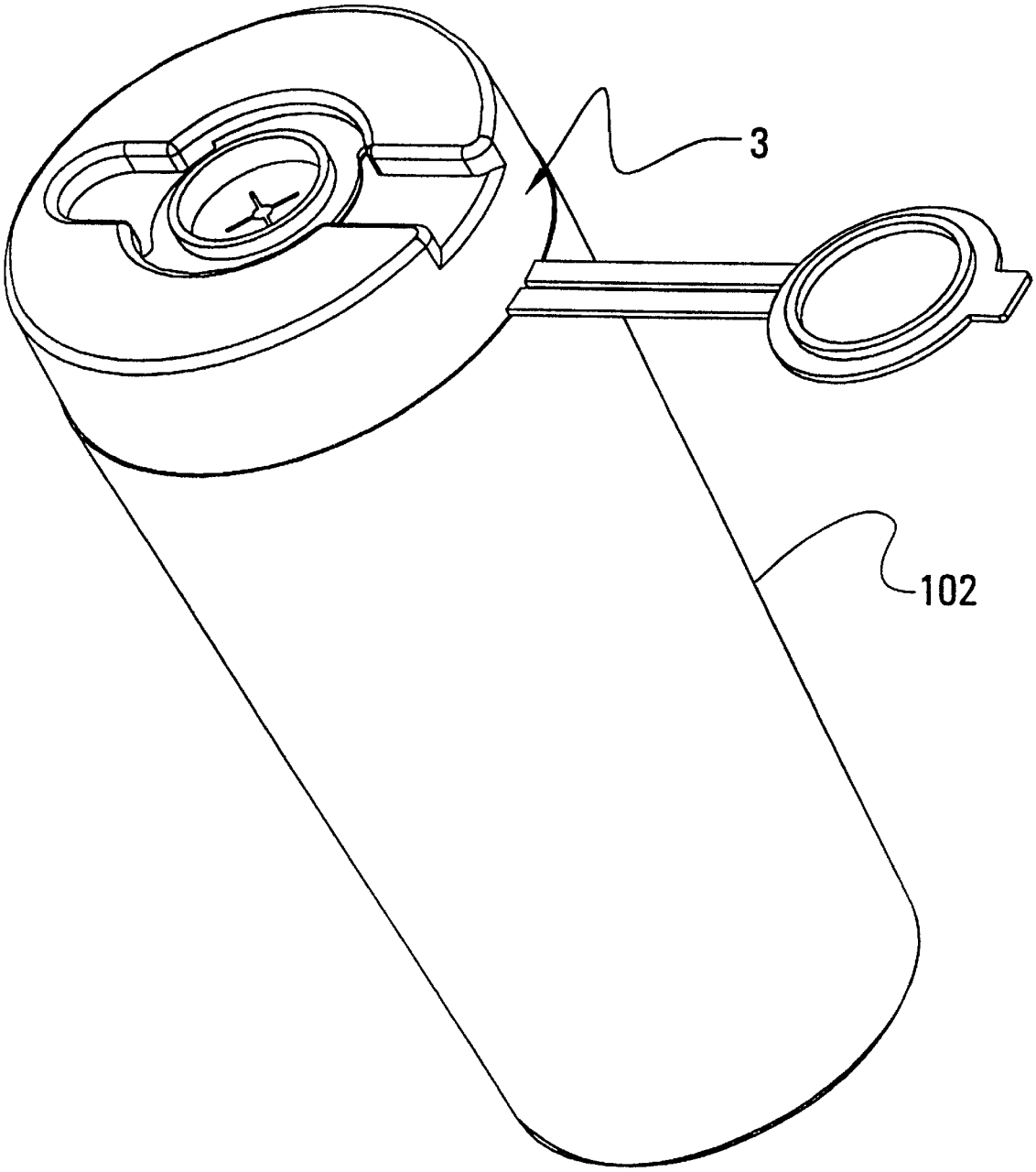
FIG. 8 is a perspective view of the container portion illustrated in FIG. 7 in combination with a dispensing cap.

Referring now to the drawings, FIGS. 7 and 8 illustrate a second alternate embodiment of the present tissue dispenser 1. In the illustrated embodiment, a container portion 102 does not include a distinct lower portion 4, transition portion 7 and upper portion 9. Rather, the container portion 102 includes a base 105 and sidewall 106 which extends upwardly from the perimeter of the base 105. The sidewall 106 is angled outwardly so that the diameter of the container portion 102 gradually increases as it extends upward from the base 105 to form a substantially conically-shaped container portion 102. The container portion 102 defines an interior space 123 for receiving tissues or other articles. As with the previously described embodiments, the base 105 preferably has a diameter of about two and six-tenths inches (2.6"). The remaining features of the present tissue dispenser 1 such as the opening 10, the topmost portion 11 and dispensing cap 3 are as previously described.

Figure 9:
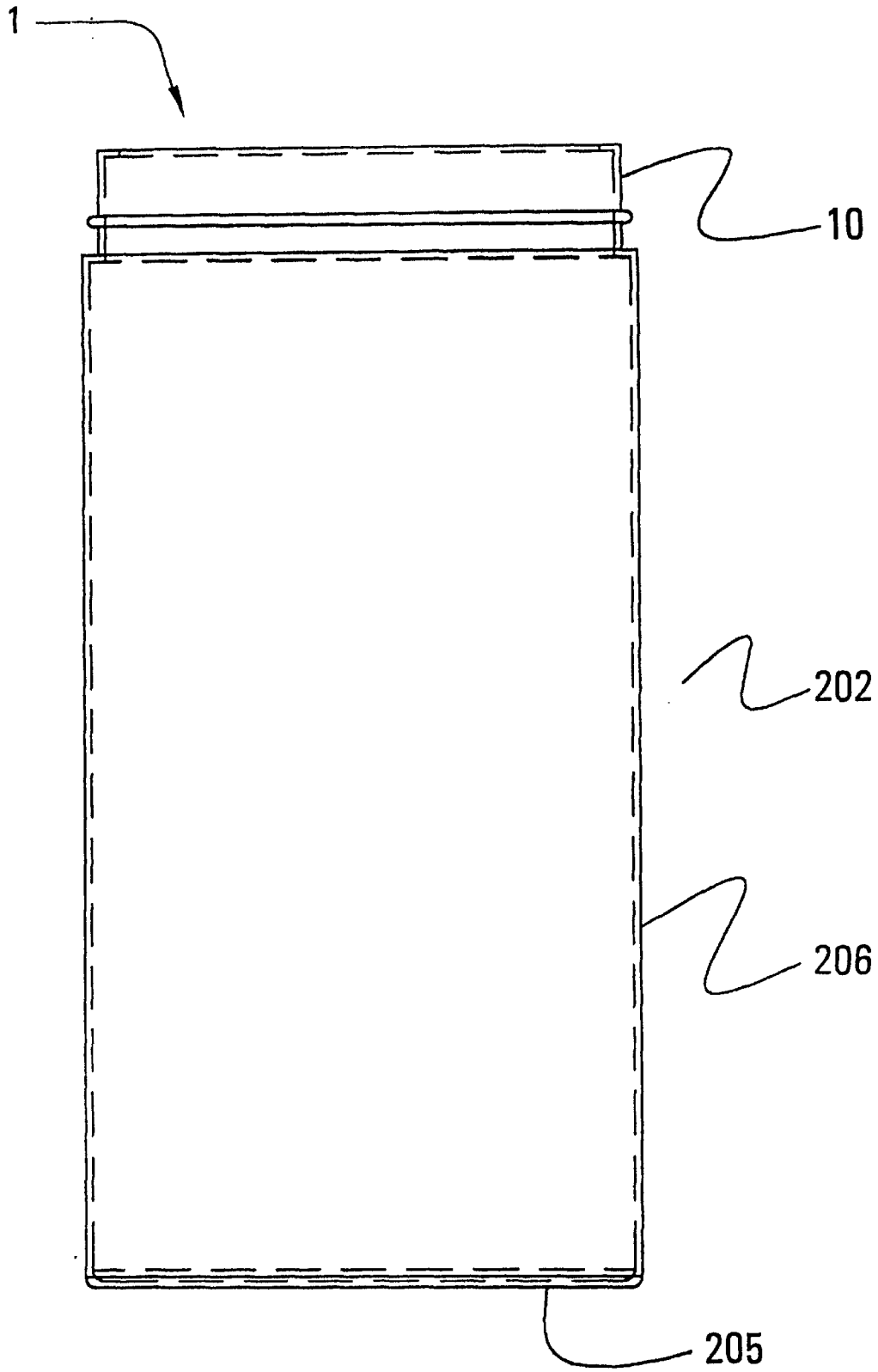
FIG. 9 is a side view of a third alternate embodiment of a container portion of the present tissue dispenser.
Figure 10:
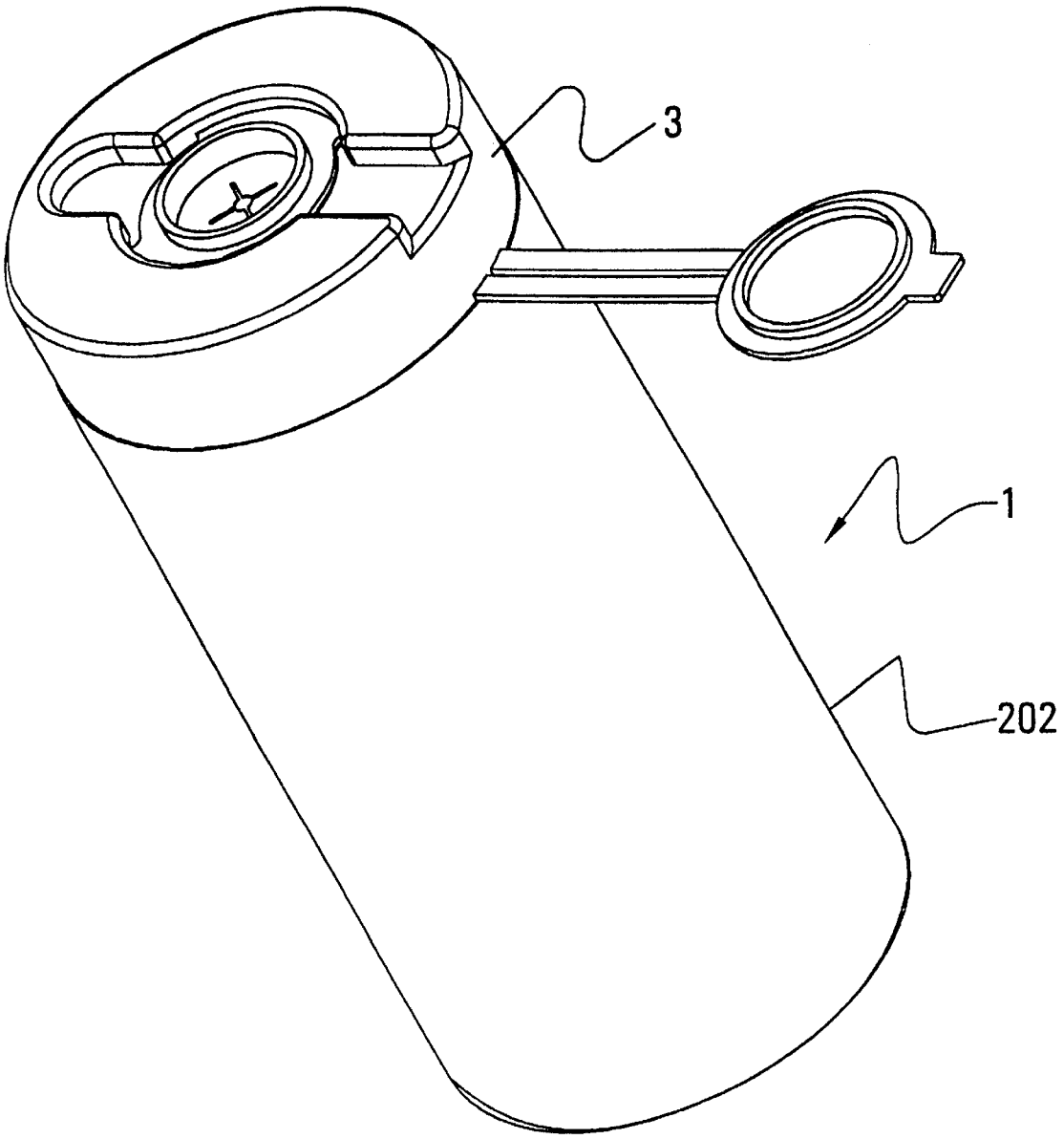
FIG. 10 is a perspective view of the container portion illustrated in FIG. 9 in combination with a dispensing cap.

A third alternate embodiment of the present tissue dispenser 1 is illustrated in FIGS. 9 and 10. The container portion 202 includes a base 205 and a sidewall 206 which extends upwardly from the perimeter of the base 205 to form a substantially cylindrically-shaped container portion 202. Currently, it is believed that there is no existing tissue dispenser which has a diameter less than around three and one-eight inches (3.125") which makes existing tissue dispensers unsuitable for non-adjustable adjustable vehicle cup holders. An important feature of the present invention is that the cylindrically-shaped container portion has a size that can be accommodated by a large variety of non-adjustable vehicle cup holders. Therefore, it is critical that the present cylindrically-shaped tissue dispenser have a diameter of around three inches (3") or less in order to fit within a non-adjustable vehicle cup holder. Preferably, the present tissue dispenser has a diameter of about two and six-tenths inches (2.6"). The remaining features of the present tissue dispenser 1 such as the opening 10, the topmost portion 11 and dispensing cap 3 are as previously described.

Although the features such as the container portion 2, 102, 202 have been described with terms such as "diameter," the container may have equivalent configurations such as square, elliptical or other cross-sectional shape, whether symmetrical or asymmetrical. In the equivalent configurations, the widest dimension of the container portion should correspond to the diameter as described above. The present tissue dispenser 1 is preferably made from a plastic such as HDPE or polypropylene or other suitable materials such as paper or composite materials. Preferably, the container portion 2 and the dispensing cap 3 are formed by blow molding . However, other methods such as injection molding may be used to manufacture the tissue dispenser 1 of the present invention. Additionally, although it is preferred that the present tissue dispenser 1 contain tissues or other substrates as a carrier, the structure described herein may be suitable for a wide variety of other applications without a substrate. For example, creams, ointments, suntan lotion or oils may be contained and dispensed from the previously described tissue dispenser. Additionally, liquids other than antimicrobial agents may be carried on the contained tissues such as aloe, medicine, automotive cleaner, glass cleaner, or stain remover.

It is understood that many changes or alterations may be made to the previously described invention described and that the above detailed description is illustrative of the many useful applications of the described tissue dispenser and should not be construed as limiting. Therefore, the following claims define the scope of the present invention.

We claim:

1. A tissue dispenser for a vehicle cup holder comprising:

a. a container portion having;
   i. a lower portion;
   ii. a transition portion extending upward from the lower portion, said transition portion being angled outwardly so that the diameter of the container portion gradually increases as the transition portion extends upward from the lower portion;
   iii. an upper portion positioned above said transition portion the upper portion having a diameter greater than the lower portion, said upper portion, transition portion and said lower portion defining an interior space within the container portion for retaining articles within the container portion;
   iv. a topmost portion positioned above the upper portion for securing a dispensing cap, said topmost portion having an outer surface;

b. a dispensing cap removably attached to the topmost portion of the container portion to seal the container, said dispensing cap comprising an aperture for dispensing articles to be retained in the container portion.

2. The tissue dispenser of claim 1 wherein said dispensing cap further includes a closable lid disposed over said aperture for covering said aperture.

3. The tissue dispenser of claim 2 wherein said aperture further includes at least one tab for separating the tissues to be retained in the tissue dispenser.

4. The tissue dispenser of claim 2 wherein said lid is secured to said dispensing cap by a strap to prevent inadvertent misplacement of the dispensing cap.

5. The tissue dispenser of claim 1 wherein said topmost portion is substantially cylindrical in shape.

6. The tissue dispenser of claim 5 wherein said dispensing cap includes a disc portion and a substantially cylindrically-shaped first sidewall portion extending downwardly from the perimeter of the disc portion, said first sidewall portion having an interior surface.

7. The tissue dispenser of claim 6 wherein said topmost portion includes a first ridge disposed around the outer surface of the topmost portion.

8. The tissue dispenser of claim 7 wherein said dispensing cap further includes a second ridge disposed around the interior surface of the sidewall portion.

9. The tissue dispenser of claim 8 wherein said second ridge rests below the first ridge when the dispensing cap is secured to the container portion.

10. The tissue dispenser of claim 1 wherein said upper portion is substantially cylindrical in shape.

11. The tissue dispenser of claim 1 wherein the lower portion has an outer diameter of about two and six-tenth inches.

* * * * *